US010161154B2

(12) United States Patent
Renaud

(10) Patent No.: US 10,161,154 B2
(45) Date of Patent: Dec. 25, 2018

(54) POOL CLEANER WITH ARTICULATED CLEANING MEMBERS AND METHODS RELATING THERETO

(71) Applicant: Hayward Industries, Inc., Elizabeth, NJ (US)

(72) Inventor: Benoit Joseph Renaud, Fort Atkinson, WI (US)

(73) Assignee: Hayward Industries, Inc., Elizabeth, NJ (US)

( * ) Notice: Subject to any disclaimer, the term of this patent is extended or adjusted under 35 U.S.C. 154(b) by 676 days.

(21) Appl. No.: 14/209,461

(22) Filed: Mar. 13, 2014

(65) Prior Publication Data

US 2014/0261540 A1 Sep. 18, 2014

Related U.S. Application Data

(60) Provisional application No. 61/783,953, filed on Mar. 14, 2013.

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... B08B 5/00; B08B 5/04; A47L 9/00; A47L 9/009; A47L 9/02; E04H 4/16; E04H 4/1636; E04H 4/1654
See application file for complete search history.

(56) References Cited

U.S. PATENT DOCUMENTS

D144,063 S 3/1946 McAllister
D175,210 S 7/1955 Dreyfuss
(Continued)

FOREIGN PATENT DOCUMENTS

AU 704603 B2 4/1999
DE 2612043 A1 9/1977
(Continued)

OTHER PUBLICATIONS

International Search Report of the International Searching Authority dated Jul. 14, 2014, issued in connection with International Application No. PCT/US2014/026294, corresponding to U.S. Appl. No. 14/209,461 (2 pages).
(Continued)

*Primary Examiner* — Joseph L. Perrin
*Assistant Examiner* — Irina Graf
(74) *Attorney, Agent, or Firm* — McCarter & English, LLP

(57) ABSTRACT

Exemplary embodiments include a pool cleaner having a body and articulated cleaning member extending from the body. The articulated cleaning member can be pivotally and/or rotatably coupled to the body. The articulated cleaning member can be pivoted or rotated with respect to the body to accommodate changes in the terrain of a pool. A method for cleaning a swimming pool is also provided where a pool cleaner having articulated cleaning members is submerged in a pool and allowing the pool cleaner to traverse an immersed surface of the pool. The method further rotates the articulated cleaning member in response to a difference in an elevation of the immersed surface between the articulated cleaning member and the body.

13 Claims, 9 Drawing Sheets

(56) References Cited

U.S. PATENT DOCUMENTS

D176,635 S 1/1956 Shalvoy
D186,872 S 12/1959 Swann
3,019,462 A 2/1962 Nash et al.
3,039,122 A 6/1962 Birdsall
3,085,267 A * 4/1963 Jacuzzi ..... A47L 9/02 15/1.7
3,310,173 A 3/1967 Sosower
3,321,787 A 5/1967 Myers
3,324,492 A 6/1967 Myers
3,360,816 A * 1/1968 Fontecchio ..... A47L 9/02 15/1.7
3,439,368 A 4/1969 Myers
RE26,741 E 12/1969 Myers
3,551,930 A 1/1971 Myers
3,665,942 A 5/1972 Moore
3,689,408 A 9/1972 Edmiston et al.
3,755,842 A 9/1973 Kislig
3,767,055 A 10/1973 Flatland
3,794,052 A 2/1974 Koble, Jr. et al.
3,797,508 A 3/1974 Jacobs
3,805,815 A 4/1974 Goodin
3,868,739 A 3/1975 Hargrave
3,886,616 A 6/1975 Hayes
3,972,339 A 8/1976 Henkin et al.
3,979,788 A 9/1976 Strausak
4,152,802 A 5/1979 Chauvier
4,154,680 A 5/1979 Sommer
4,156,948 A 6/1979 Chauvier et al.
4,168,557 A 9/1979 Rasch et al.
4,193,156 A 3/1980 Chauvier
4,208,752 A 6/1980 Hofmann
4,240,174 A * 12/1980 Thiem ..... A47L 9/02 15/1.7
4,281,995 A 8/1981 Pansini
4,299,051 A 11/1981 Pauly et al.
4,306,329 A 12/1981 Yokoi
4,338,697 A 7/1982 Broadwater
4,351,077 A 9/1982 Hofmann
4,402,101 A 9/1983 van Zyl
4,431,538 A 2/1984 Selsted
4,449,265 A 5/1984 Hoy
4,536,908 A 8/1985 Raubenheimer
4,558,479 A 12/1985 Greskovics et al.
4,589,986 A 5/1986 Greskovics et al.
4,637,086 A * 1/1987 Goode ..... E04H 4/1636 15/1.7
4,651,376 A 3/1987 Ford
4,652,366 A 3/1987 Brooks
4,692,956 A 9/1987 Kassis
4,761,848 A 8/1988 Hofmann
4,768,532 A 9/1988 Johnson
4,769,867 A 9/1988 Stoltz
4,778,599 A 10/1988 Brooks
4,807,318 A 2/1989 Kallenbach
4,835,810 A * 6/1989 Hugo ..... E04H 4/1636 15/1.7
4,849,024 A 7/1989 Supra
D304,505 S 11/1989 Maier et al.
4,920,599 A 5/1990 Rief
4,950,393 A 8/1990 Goettl
4,959,146 A 9/1990 Kristan
4,962,559 A 10/1990 Schuman
D315,624 S 3/1991 Kimura et al.
5,001,800 A 3/1991 Parenti et al.
5,014,382 A 5/1991 Kallenbach
5,033,149 A * 7/1991 Russo ..... E04H 4/1636 15/1.7
5,093,950 A 3/1992 Heier
5,097,559 A 3/1992 Brunt et al.
5,099,535 A 3/1992 Chauvier et al.
D325,452 S 4/1992 Gefter
D325,796 S 4/1992 Kallenbach
5,105,496 A 4/1992 Gray, Jr. et al.
5,172,445 A 12/1992 Chandler
5,197,158 A 3/1993 Moini
5,226,205 A 7/1993 Pearce
5,245,723 A 9/1993 Sommer
5,265,297 A 11/1993 Gould et al.
5,293,659 A 3/1994 Rief et al.
D346,888 S 5/1994 Stone
5,337,434 A 8/1994 Erlich
5,351,355 A 10/1994 Chiniara
5,398,361 A * 3/1995 Cason ..... A47L 9/02 15/1.7
5,412,826 A 5/1995 Raubenheimer
5,435,031 A 7/1995 Minami et al.
D361,178 S 8/1995 Piret
5,450,644 A 9/1995 Berman
5,450,645 A 9/1995 Atkins
5,507,058 A 4/1996 Minami et al.
D373,230 S 8/1996 Sebor et al.
5,546,982 A 8/1996 Clark et al.
5,569,371 A 10/1996 Perling
D375,592 S 11/1996 Ljunggren
5,603,135 A 2/1997 Jones et al.
5,604,950 A 2/1997 Stern
5,617,600 A 4/1997 Frattini et al.
5,634,229 A 6/1997 Stoltz
D384,782 S 10/1997 Gefter
5,720,068 A 2/1998 Clark et al.
5,771,987 A 6/1998 Marbach
5,794,293 A 8/1998 Hoffinger
5,797,156 A 8/1998 Sebor
5,802,653 A 9/1998 Roumagnac
D400,319 S 10/1998 Hofheins et al.
5,842,243 A 12/1998 Horvath et al.
D408,104 S 4/1999 Adam
5,893,188 A 4/1999 Campbell et al.
5,896,610 A 4/1999 Sebor et al.
5,930,856 A 8/1999 Van Der Meyden et al.
5,933,899 A 8/1999 Campbell et al.
5,935,179 A 8/1999 Kleiner et al.
5,947,051 A * 9/1999 Geiger ..... B62D 57/00 114/222
5,961,822 A 10/1999 Polimeni, Jr.
5,970,557 A 10/1999 Supra
D417,047 S 11/1999 Tsuda
D417,322 S 11/1999 Hollinger
5,985,156 A 11/1999 Henkin et al.
D418,640 S 1/2000 Veloskey et al.
6,013,178 A 1/2000 Strano et al.
6,039,886 A 3/2000 Henkin et al.
6,049,933 A 4/2000 McLaughlin
6,090,219 A 7/2000 Henkin et al.
D429,393 S 8/2000 Rief et al.
D430,368 S 8/2000 Porat et al.
6,094,764 A 8/2000 Veloskey et al.
6,099,658 A 8/2000 Porat
D430,960 S 9/2000 van der Meyden et al.
D430,962 S 9/2000 Porat et al.
6,112,354 A 9/2000 Stoltz et al.
6,115,864 A 9/2000 Davidsson et al.
6,119,293 A 9/2000 Phillipson et al.
6,125,492 A 10/2000 Prowse
D433,545 S 11/2000 Hollinger et al.
6,155,657 A 12/2000 Erlich et al.
D436,700 S 1/2001 Forbes et al.
6,206,547 B1 3/2001 Erlich
6,212,725 B1 4/2001 Porat
D445,225 S 7/2001 Schaub
6,280,611 B1 8/2001 Henkin et al.
6,292,970 B1 9/2001 Rief et al.
6,294,084 B1 9/2001 Henkin et al.
6,299,699 B1 10/2001 Porat et al.
6,309,468 B1 10/2001 Sommer
6,311,353 B1 11/2001 Phillipson et al.
6,365,039 B1 4/2002 Henkin et al.
6,387,250 B1 5/2002 Henkin et al.
6,398,878 B1 6/2002 Henkin et al.
6,409,916 B1 6/2002 Zelas et al.
6,412,133 B1 7/2002 Erlich et al.
D463,889 S 10/2002 Buzzi
6,473,927 B1 11/2002 Sommer

(56) References Cited

U.S. PATENT DOCUMENTS

| | | | |
|---|---|---|---|
| 6,485,638 | B2 | 11/2002 | Henkin et al. |
| D469,589 | S | 1/2003 | Wichmann et al. |
| 6,502,269 | B1 | 1/2003 | Balchan et al. |
| D474,312 | S | 5/2003 | Stephens et al. |
| 6,564,417 | B2 | 5/2003 | Porat |
| 6,601,255 | B1 | 8/2003 | van der Meyden et al. |
| 6,627,074 | B2 | 9/2003 | Lincke |
| D481,181 | S | 10/2003 | Lath et al. |
| 6,652,742 | B2 | 11/2003 | Henkin et al. |
| 6,665,900 | B2 | 12/2003 | Wichmann et al. |
| RE38,479 | E | 3/2004 | Henkin et al. |
| 6,742,613 | B2 | 6/2004 | Erlich et al. |
| 6,751,822 | B2 | 6/2004 | Phillipson et al. |
| 6,758,226 | B2 | 7/2004 | Porat |
| 6,802,963 | B2 | 10/2004 | Campbell |
| 6,815,918 | B2 | 11/2004 | Porat et al. |
| 6,842,931 | B2 | 1/2005 | Porat et al. |
| 6,854,148 | B1 | 2/2005 | Rief et al. |
| 6,886,205 | B1 | 5/2005 | Pichon |
| 6,954,960 | B2 | 10/2005 | Pichon |
| 6,965,814 | B2 | 11/2005 | Hadari |
| 6,971,136 | B2 | 12/2005 | Horvath et al. |
| 6,979,400 | B2 | 12/2005 | Bauckman et al. |
| 7,039,980 | B2 | 5/2006 | Van Der Meyden et al. |
| D524,495 | S | 7/2006 | Ljunggren |
| D526,101 | S | 8/2006 | Blanc-Tailleur |
| 7,089,876 | B2 | 8/2006 | Porat |
| 7,103,449 | B2 | 9/2006 | Woo et al. |
| D529,669 | S | 10/2006 | Blanc-Tailleur |
| 7,117,554 | B2 | 10/2006 | Pichon |
| 7,118,632 | B2 | 10/2006 | Sumonthee |
| 7,118,678 | B2 | 10/2006 | Porat |
| 7,143,502 | B2 | 12/2006 | Porat et al. |
| 7,165,284 | B2 | 1/2007 | Erlich et al. |
| D537,576 | S | 2/2007 | Koury et al. |
| 7,213,287 | B2 | 5/2007 | Hui |
| D550,906 | S | 9/2007 | Fritz et al. |
| 7,316,751 | B2 | 1/2008 | Horvath et al. |
| 7,318,448 | B2 | 1/2008 | Fleischer et al. |
| 7,395,571 | B2 | 7/2008 | Van Der Meijden et al. |
| 7,515,991 | B2 | 4/2009 | Egawa et al. |
| 7,520,282 | B2 † | 4/2009 | Stoltz |
| D598,168 | S | 8/2009 | Sumonthee |
| 7,661,381 | B2 | 2/2010 | Gorelik et al. |
| 7,682,461 | B2 | 3/2010 | Sommer et al. |
| 7,690,066 | B2 | 4/2010 | Stoltz et al. |
| 7,723,934 | B2 | 5/2010 | Adam et al. |
| 7,786,381 | B2 | 8/2010 | Henkin et al. |
| 7,805,792 | B2 | 10/2010 | Roumagnac |
| 7,827,643 | B2 | 11/2010 | Erlich et al. |
| 7,900,308 | B2 | 3/2011 | Erlich et al. |
| 7,908,697 | B2 | 3/2011 | Lavabre et al. |
| 8,007,653 | B2 | 8/2011 | Porat |
| 8,266,752 | B2 | 9/2012 | Henkin et al. |
| 8,296,891 | B1 | 10/2012 | Rowam et al. |
| 8,307,485 | B2 | 11/2012 | Sumonthee |
| 8,343,339 | B2 | 1/2013 | Sumonthee |
| 8,375,497 | B1 * | 2/2013 | Fitzen ..... E04H 4/1636 15/1.7 |
| 8,402,585 | B2 | 3/2013 | Rief et al. |
| 8,434,182 | B2 | 5/2013 | Horvath et al. |
| 8,709,243 | B2 | 4/2014 | Hui |
| 2002/0104790 | A1 | 8/2002 | Lincke |
| 2002/0116772 | A1 | 8/2002 | Phillipson et al. |
| 2003/0177594 | A1 | 9/2003 | Van Der Meyden et al. |
| 2004/0021439 | A1 | 2/2004 | Porat et al. |
| 2004/0074524 | A1 | 4/2004 | Horvath et al. |
| 2004/0216251 | A1 | 11/2004 | Van Der Meijden et al. |
| 2005/0279682 | A1 | 12/2005 | Davidson et al. |
| 2006/0059637 | A1 | 3/2006 | Fridman et al. |
| 2006/0207041 | A1 | 9/2006 | Van Der Meyden et al. |
| 2006/0225768 | A1 | 10/2006 | Erlich |
| 2007/0028405 | A1 | 2/2007 | Garti |
| 2007/0056124 | A1 | 3/2007 | Wichmann et al. |
| 2007/0067930 | A1 | 3/2007 | Garti |
| 2007/0094817 | A1 | 5/2007 | Stoltz et al. |
| 2007/0251032 | A1 | 11/2007 | Pichon et al. |
| 2008/0060984 | A1 | 3/2008 | Henkin et al. |
| 2008/0087299 | A1 | 4/2008 | Erlich et al. |
| 2008/0099409 | A1 | 5/2008 | Gorelik et al. |
| 2008/0128343 | A1 | 6/2008 | Garti |
| 2008/0202997 | A1 | 8/2008 | Davidson et al. |
| 2008/0222821 | A1 | 9/2008 | Pichon |
| 2008/0235887 | A1 | 10/2008 | Horvath et al. |
| 2008/0236628 | A1 | 10/2008 | Horvath et al. |
| 2008/0250580 | A1 | 10/2008 | Lavabre et al. |
| 2008/0276388 | A1 | 11/2008 | Dodd |
| 2008/0307589 | A1 | 12/2008 | Schneider et al. |
| 2009/0045110 | A1 | 2/2009 | Garti |
| 2009/0232701 | A1 | 9/2009 | Porat |
| 2009/0282627 | A1 | 11/2009 | Porat |
| 2009/0301522 | A1 | 12/2009 | Abehasera et al. |
| 2009/0307854 | A1 | 12/2009 | Garti |
| 2010/0043154 | A1 | 2/2010 | Kellogg |
| 2010/0058546 | A1 | 3/2010 | Erlich |
| 2010/0065482 | A1 | 3/2010 | Sumonthee |
| 2010/0132136 | A1 | 6/2010 | Sommer et al. |
| 2011/0067729 | A1 | 3/2011 | Erlich et al. |
| 2011/0088182 | A1 | 4/2011 | Hui |
| 2011/0203060 | A1 | 8/2011 | Pichon et al. |
| 2011/0314617 | A1 | 12/2011 | Van Der Meijden et al. |
| 2012/0060307 | A1 | 3/2012 | Stoltz |
| 2014/0101870 | A1 * | 4/2014 | Lopez ..... E04H 4/1654 15/1.7 |

FOREIGN PATENT DOCUMENTS

| | | | |
|---|---|---|---|
| DE | 3110203 | A1 | 9/1982 |
| EP | 0314259 | A2 | 5/1989 |
| EP | 0323883 | A1 | 7/1989 |
| EP | 0426365 | A1 | 5/1991 |
| EP | 0468876 | A1 | 1/1992 |
| EP | 0565226 | A1 | 10/1993 |
| EP | 0657603 | A1 | 6/1995 |
| EP | 0990749 | A2 | 4/2000 |
| EP | 0990750 | A2 | 4/2000 |
| EP | 1122382 | A1 | 8/2001 |
| EP | 1489249 | A2 | 12/2004 |
| EP | 1785552 | A2 | 5/2007 |
| EP | 1849934 | A1 | 10/2007 |
| EP | 1921229 | A2 | 5/2008 |
| FR | 2584442 | A1 | 1/1987 |
| FR | 2693499 | A1 | 1/1994 |
| FR | 2729995 | A1 | 8/1996 |
| FR | 2864129 | A1 | 6/2005 |
| FR | 2925557 | A1 | 6/2009 |
| FR | 2929310 | A1 | 10/2009 |
| WO | 8700883 | A1 | 2/1987 |
| WO | 9009498 | A1 | 8/1990 |
| WO | 99/63185 | A1 | 12/1999 |
| WO | 0127415 | A1 | 4/2001 |
| WO | 2001/092663 | | 12/2001 |
| WO | 0192664 | A1 | 12/2001 |
| WO | WO 01/92663 | A1 | 12/2001 |
| WO | WO-0192663 | A1 * | 12/2001 ..... E04H 4/1654 |
| WO | 03085225 | A1 | 10/2003 |
| WO | 2004038130 | A2 | 5/2004 |
| WO | 2005007998 | A2 | 1/2005 |
| WO | 2005118984 | A2 | 12/2005 |
| WO | 2006109118 | A1 | 10/2006 |
| WO | 2006121808 | A2 | 11/2006 |
| WO | 2007055960 | A2 | 5/2007 |
| WO | 2008096323 | A2 | 8/2008 |
| WO | 2008102325 | A1 | 8/2008 |
| WO | 2011049594 | A1 | 4/2011 |
| WO | 2014052234 | A2 | 4/2014 |
| WO | 2015031150 | A1 | 3/2015 |

OTHER PUBLICATIONS

Written Opinion dated Jul. 14, 2014, issued in connection with International Application No. PCT/US2014/026294, corresponding to U.S. Appl. No. 14/209,461(8 pages).

(56) References Cited

OTHER PUBLICATIONS

Digital Image of Pool Rover Cleaner (more than one year prior to Sep. 16, 2008) (1 page) Exact Date Unknown.
Digital Image of Robby Cleaner (more than one year prior to Sep. 16, 2008) (1 page) Exact Date Unknown.
Digital Image of Dolphin Cleaner (more than one year prior to Sep. 16, 2008) (1 page) Exact Date Unknown.
Digital Image of Merlin Cleaner (more than one year prior to Sep. 16, 2008) (1 page) Exact Date Unknown.
Digital Image of Aquabot Cleaner (more than one year prior to Sep. 16, 2008) (1 page) Exact Date Unknown.
Dolphin Cleaner photos (3 pages) and Dolphin Cleaner page (2 pages) (Cleaner seen at a show circa Oct. 2009) Exact Date Unknown.
Zodiac Cybemaut Manual (dated Sep. 3, 2006) (6 pages).
Polaris 9300 and Vortex 3 Cleaners (manuals dated Copyright 2010 and V3 cleaner seen at a show circa Oct. 2009) (125 pages) Exact Date Unknown.
Hexagone Cleaners (more than one year prior to Sep. 16, 2008) (8 pages).
Caratti Catalog (dated 2007) (8 pages).
Brock Catalog (dated 2005) (8 pages).
Tiger Shark Owner's Manual (Mar. 2007) (16 pages) Exact Date Unknown.
Digital Image of Squirrel Cleaner (more than one year prior to Sep. 16, 2008) (1 page) Exact Date Unknown.
Cleaner shown at archive.org, link for Apr. 4, 2007 (2 sheets): http://web.archive.org/web/20070404093845/http:/www.mariner-3s.com/mariner_en/produkte/navigator/navigator.php.
Office Action dated Jun. 11, 2012 in connection with U.S. Appl. No. 12/938,041 (6 pages).
Office Action dated Aug. 28, 2012 in connection with U.S. Appl. No. 12/938,041 (11 pages).
Notice of Allowance dated May 4, 2009 issued in connection with U.S. Appl. No. 29/324,616, filed Sep. 16, 2008 (7 pages).
Office Action dated Oct. 11, 2011 issued in connection with U.S. Appl. No. 29/378,304 (5 pages).
Notice of Allowance dated Feb. 15, 2012 issued in connection with U.S. Appl. No. 29/378,304 (5 pages).
YouTube Video of Mopper Cleaner, http://www.youtube.com/watch?v=d8NAUWH0QCk&feature=BFa&list=ULopZLfx7W4Po, e.g., attached screen shots (45 pages).
Notice of Allowance dated Jul. 6, 2012 issued in connection with U.S. Appl. No. 13/213,514 including Statement of Reasons for Allowance (7 pages).
Office Action dated Dec. 28, 2011 issued in connection with U.S. Appl. No. 13/213,514 (8 pages).
Notice of Allowance dated Aug. 27, 2012 issued in connection with U.S. Appl. No. 12/211,720 (8 pages).
Restriction Requirement dated Jul. 19, 2010 issued in connection with U.S. Appl. No. 12/211,720 (7 pages).
Dolphin Dx2 Hybrid Advertisement (dated 2009) (2 pages).
DX3 and DX4 Cleaners and Related Manuals (more than one year prior to Sep. 16, 2008) (17 pages) Exact Date Unknown.
Picture Sheet Showing Multiple Commercial Cleaners (more than one year prior to Sep. 16, 2008) (1 page) Exact Date Unknown.
Picture Sheet Showing Multiple Double-Wide Cleaners (more than one year prior to Sep. 16, 2008) (1 page) Exact Date Unknown.
Smartpool Nitro Cleaner Manual (more than one year prior to Sep. 16, 2008) (56 pages) Exact Date Unknown.
AquaBot Advertisement, Pool & Spa News (Oct. 2009) (2 pages).
Wave Cleaner (cleaner seen at show circa Oct./Nov. 2008) (25 pages) Exact Date Unknown.
U.S. Appl. No. 29/378,304 entitled "Pool Cleaner", filed Nov. 2, 2010 (7 pages).
Office Action dated Feb. 14, 2011 in connection with U.S. Appl. No. 12/211,720 (7 pages).
Dolphin 2x2 (more than one year prior to Sep. 16, 2008) (8 pages).
Hayward Tiger Shark Series Owner's Manual (16 pages) (more than one year prior to Nov. 2, 2009).
Office Action dated Sep. 30, 2013, from U.S. Appl. No. 12/890,069 (8 pages).
Notice of Allowance dated Oct. 1, 2003, from U.S. Appl. No. 10/279,520 (8 pages).
Notice of Allowance dated Oct. 23, 2014 issued by the Canadian Intellectual Property Office in connection with Canadian Patent Application No. 2,774,338 (2 pages).
Office Action dated Feb. 19, 2014, from U.S. Appl. No. 12/938,041 (13 pages).
Office Action dated Sep. 26, 2011 issued in connection with U.S. Appl. No. 12/211,720 (7 pages).
Office Action dated Nov. 7, 2013 issued in connection with U.S. Appl. No. 13/601,436 (33 pages).
Notice of Allowance dated Oct. 15, 2013 in connection with U.S. Appl. No. 12/938,041 (7 pages).
Notice of Allowance dated Jun. 2, 2014, from U.S. Appl. No. 12/890,069 (8 pages).
Notice of Allowance dated Feb. 6, 2014, from U.S. Appl. No. 12/890,069 (8 pages).
Office Action dated Apr. 26, 2013 issued in connection with U.S. Appl. No. 12/938,041 (9 pages).
Notice of Allowance dated May 10, 2012 issued in connection with U.S. Appl. No. 12/211,720 (8 pages).
Notice of Allowance dated Feb. 2, 2012 from U.S. Appl. No. 12/211,720 (8 pages).
Office Action dated Nov. 13, 2013 issued in connection with European Patent Application Serial No. 05753885.2 (12 pages).
Office Action dated Mar. 12, 2013 issued in connection with U.S. Appl. No. 13/722,112 (12 pages).
Office Action dated Apr. 3, 2013, from U.S. Appl. No. 12/890,069 (9 pages).
Requisition dated Nov. 18, 2013 issued by the Canadian Intellectual Property Office in connection with Canadian Patent Application No. 2,774,338 (3 pages).
Written Opinion of the International Searching Authority dated Feb. 6, 2015, issued in connection with International Application No. PCT/US2014/52034 (11 pages).
International Search Report of the International Searching Authority dated Feb. 6, 2015, issued in connection with International Application No. PCT/US2014/52034 (5 pages).
Written Opinion of the International Searching Authority dated Apr. 23, 2014, issued in connection with International Application No. PCT/US2013/61174 (5 pages).
International Search Report of the International Searching Authority dated Apr. 23, 2014, issued in connection with International Application No. PCT/US2013/61174 (5 pages).
International Search Report of the International Searching Authority dated Dec. 8, 2004, issued in connection with International Application No. PCT/US2003/33519 (2 pages).
International Search Report of the International Searching Authority dated Apr. 20, 2004, issued in connection with International Application No. PCT/US2003/32503 (1 page).
Notice of Allowance dated May 5, 2004, from U.S. Appl. No. 10/296,779 (6 pages).
Office Action dated May 9, 2008, from U.S. Appl. No. 11/770,831 (8 pages).
Office Action dated Sep. 18, 2008, from U.S. Appl. No. 11/770,831 (7 pages).
Office Action dated Jan. 27, 2015, from U.S. Appl. No. 13/568,838 (18 pages).
Notice of Allowance dated Dec. 13, 2012, from U.S. Appl. No. 12/581,405 (12 pages).
International Search Report of the International Searching Authority dated Nov. 2, 2010, issued in connection with International Application No. PCT/US2010/02359 (2 pages).
Written Opinion of the International Searching Authority dated Nov. 2, 2010, issued in connection with International Application No. PCT/US2010/02359 (5 pages).
Notice of Allowance dated Nov. 28, 2008, from U.S. Appl. No. 11/770,831 (5 pages).
International Search Report of the International Searching Authority dated Oct. 13, 2000, issued in connection with International Application No. PCT/US00/40167 (1 page).

(56) References Cited

OTHER PUBLICATIONS

International Preliminary Examination Report dated Jun. 7, 2001, issued in connection with International Application No. PCT/US2000/28144 (3 pages).
International Search Report of the International Searching Authority dated Jan. 19, 2001, issued in connection with International Application No. PCT/US2000/28144 (1 page).
Office Action dated Jun. 29, 2004, from U.S. Appl. No. 10/296,778 (9 pages).
Notice of Allowance dated Oct. 19, 2004, from U.S. Appl. No. 10/296,778 (7 pages).
International Search Report of the International Searching Authority dated Sep. 7, 2000, issued in connection with International Application No. PCT/US2000/14770 (1 page).
International Preliminary Examination Report dated Mar. 13, 2002, issued in connection with International Application No. PCT/US2000/14770 (7 pages).
International Search Report of the International Searching Authority dated Oct. 3, 2000, issued in connection with International Application No. PCT/US2000/14771 (1 page).
International Preliminary Examination Report dated Aug. 19, 2002, issued in connection with International Application No. PCT/US2000/14771 (15 pages).
International Search Report of the International Searching Authority dated Sep. 18, 2000, issued in connection with International Application No. PCT/US00/14772 (2 pages).
International Preliminary Examination Report dated Jun. 21, 2001, issued in connection with International Application No. PCT/US2000/14772 (7 pages).
Photo of Zodiac pool cleaner, printed on Aug. 3, 2012 from www.zodiacpoolsystems.com.
Office Action dated Jul. 21, 2015, from U.S. Appl. No. 13/627,637 (12 pages).
Office Action dated Aug. 11, 2016, issued in connection with U.S. Appl. No. 29/508,541 (8 pages).
Office Action dated Aug. 3, 2016, issued in connection with U.S. Appl. No. 29/508,549 (7 pages).
Office Action dated Aug. 25, 2016, issued in connection with U.S. Appl. No. 29/508,552 (6 pages).
Notice of Allowance dated Feb. 13, 2017, issued in connection with U.S. Appl. No. 29/508,552 (8 pages).
Notice of Allowance dated Feb. 10, 2017, issued in connection with U.S. Appl. No. 29/508,549 (8 pages).
Notice of Allowance dated Feb. 9, 2017, issued in connection with U.S. Appl. No. 29/508,541 (8 pages).
Office Action dated Aug. 26, 2016, issued in connection with U.S. Appl. No. 29/508,554 (6 pages).
Notice of Allowance dated Mar. 3, 2017, issued in connection with U.S. Appl. No. 29/508,554 (9 pages).

* cited by examiner
† cited by third party

POOL CLEANER WITH ARTICULATED CLEANING MEMBERS AND METHODS RELATING THERETO

CROSS REFERENCE TO RELATED APPLICATIONS

The present application claims priority to U.S. Provisional Patent Application No. 61/783,953, filed on Mar. 14, 2013, the disclosure of which is incorporated herein by reference in its entirety.

BACKGROUND

Field of Technology

The present disclosure generally relates to apparatus for cleaning a pool. More particularly, exemplary embodiments of the disclosure relate to automatic pool cleaning apparatus with articulated cleaning members.

Brief Discussion of Related Art

Swimming pools commonly require a significant amount of maintenance. Beyond the treatment and filtration of pool water, the surface of the bottom wall (the "floor"), side walls of a pool (the floor and the side walls collectively, the "walls" of the pool), steps, and the surfaces of any other features in the pool must be scrubbed regularly. Additionally, leaves and other debris often times elude a pool filtration system and settle on the bottom of the pool. Conventional automated pool cleaning devices can traverse the surfaces to be cleaned. However, some conventional pool cleaning device cannot effectively accommodate changes in the terrain of the surfaces of a pool. For example, raised drain covers, steps, benches, and intersections between the pool floor and side walls can cause conventional pool cleaning devices to move away from the surface to be cleaned, thereby reducing the effectiveness of the pool cleaning device from cleaning the surface.

Known features of automated pool cleaning devices which allow them to traverse the surfaces to be cleaned in an efficient and effective manner are beneficial. Notwithstanding, such knowledge in the prior art, features which provide enhanced cleaner traversal of pool surfaces to be cleaned that have varying surface elevations remain a desirable objective.

SUMMARY

The present disclosure relates to apparatus for facilitating operation of a pool cleaner in cleaning surfaces of a pool containing water. Exemplary embodiments of the pool cleaner can have a body and articulated cleaning members extending from the body such that the articulated cleaning members can be pivotally and/or rotatably coupled to the body. The articulated cleaning members can be pivoted and/or rotated with respect to the body to accommodate changes in the terrain of a pool while allowing a suction inlet of the pool cleaner to maintain close proximity to the surface of the pool being cleaned.

In accordance with embodiments of the present disclosure, an apparatus for cleaning a swimming pool is disclosed that includes a body and an articulated cleaning member. The body has a pair of opposingly spaced wheels, an inlet disposed between the wheels through which water enters the body, and an outlet through which water exits the body. The articulated cleaning member is operatively coupled to a side of the body adjacent to a first one of the wheels and is separated from the inlet by the fist one of the wheels. The articulated cleaning member is moveable with respect to the body to accommodate changes in terrain of a pool surface.

In accordance with embodiments of the present disclosure, an apparatus for cleaning a swimming pool is disclosed that has a body, a first articulated cleaning member, a first biasing member, a second articulated cleaning member, and a second biasing member. The body has an inlet through which water enters the body and an outlet through which water exits the body. The first articulated cleaning member extends from and is operatively coupled to a first side of the body, and is moveable with respect to the body to accommodate changes in terrain of a pool surface. The first biasing member is operatively coupled between the body and the first articulated cleaning member to urge the articulated cleaning member towards a surface to be cleaned. The second articulated cleaning member extends from and is operatively coupled to a second side of the body, and is moveable with respect to the body to accommodate changes in terrain of the pool surface. The second biasing member is operatively coupled between the body and the second articulated cleaning member to urge the second articulated cleaning member towards the surface to be cleaned.

In accordance with embodiments of the present disclosure, a method of cleaning a pool is described that includes submerging a pool cleaner in a pool, traversing a terrain of an immersed surface of the pool by the pool cleaner, rotating the articulated cleaning member with respect to the body in response to a difference in an elevation of the immersed surface between the articulated cleaning member and the body, and urging the articulated cleaning member towards the immersed surface via a biasing force that is less than a suction force generated by the pool cleaner. In some embodiments, the method can include rotating the articulated the articulated cleaning member with respect to the body in response to the elevation of the immersed surface between the articulated cleaning member and the body being substantially equal. The pool cleaner has a body that includes a pair of opposingly spaced wheels, an inlet disposed between the wheels through which water enters the body, an outlet through which water exits the body, and an articulated cleaning member operatively coupled to a side of the body adjacent a first one of the wheels. The articulated cleaning member being separated from the inlet by the fist one of the wheels and being moveable with respect to the body to accommodate changes in terrain of a pool surface.

In accordance with embodiments of the present disclosure, a biasing member can be operatively coupled between the body and each of the articulated cleaning members to apply biasing forces to the articulated cleaning members. In some embodiments, the biasing members can include springs, such as a coil spring and/or a torsion spring. The body can generate a suction force to urge a bottom of the body towards the pool surface and the articulated cleaning member can exert a biasing force against the pool surface. The suction force can be greater than the biasing force. In some embodiments, the articulated cleaning members are each operatively coupled to the body by a hinge.

In accordance with embodiments of the present disclosure, the articulated cleaning members can include a housing, a wheel, and an axle operatively coupled to the wheel and disposed within the housing. The axle of each articulated cleaning member can operatively couple the articulated cleaning members to the body. In some embodiments, the axle can be operatively coupled to the body by a joint that permits pivotal or rotational movement of the articulated cleaning members with respect to the body. In some embodiments, the axle can be driven to rotate the wheel.

In accordance with embodiments of the present disclosure, the body can include a housing, a drive system, a chassis supporting the housing and the drive system, and a plurality of wheels operatively coupled drive system. The drive system can be configured to drive the wheels to move the body.

In accordance with embodiments of the present disclosure, the articulated cleaning members can be configured to perform compound movements. To facilitate compound movements, the articulated cleaning members can each include a first sub-portion operatively coupled to the body and a second sub-portion operatively coupled to the first portion. The first sub-portion can be pivotally or rotationally coupled to the body and the second sub-portion can be pivotally or rotationally coupled to the first sub-portion such that the first and second sub-segments are movable with respect to each other and with respect to the body.

In accordance with embodiments of the present disclosure, the apparatus can be at least one of a negative pressure pool cleaner, an electric pool cleaner, or a positive pressure pool cleaner.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the invention.

DETAILED DESCRIPTION OF EXEMPLARY EMBODIMENTS

According to the present disclosure, advantageous pool cleaning apparatus are provided for facilitating maintenance and cleaning of a swimming pool. More particularly, the present disclosure, includes, but is not limited to, a pool cleaner having one or more articulated cleaning members to accommodate changes in the terrain of a swimming pool, spa or other reservoir. In exemplary embodiments of the present disclosure, pivoting and/or rotating of the articulated cleaning members in response to changes in the terrain of the pool surface can enable one or more suction inlets of the pool cleaner to remain in close proximity to the pool surface to maintain a sufficient suction force of the pool cleaner to the pool surface to clean the surface and/or to enable wheels of the cleaner to have traction against the surface.

Figure 1:
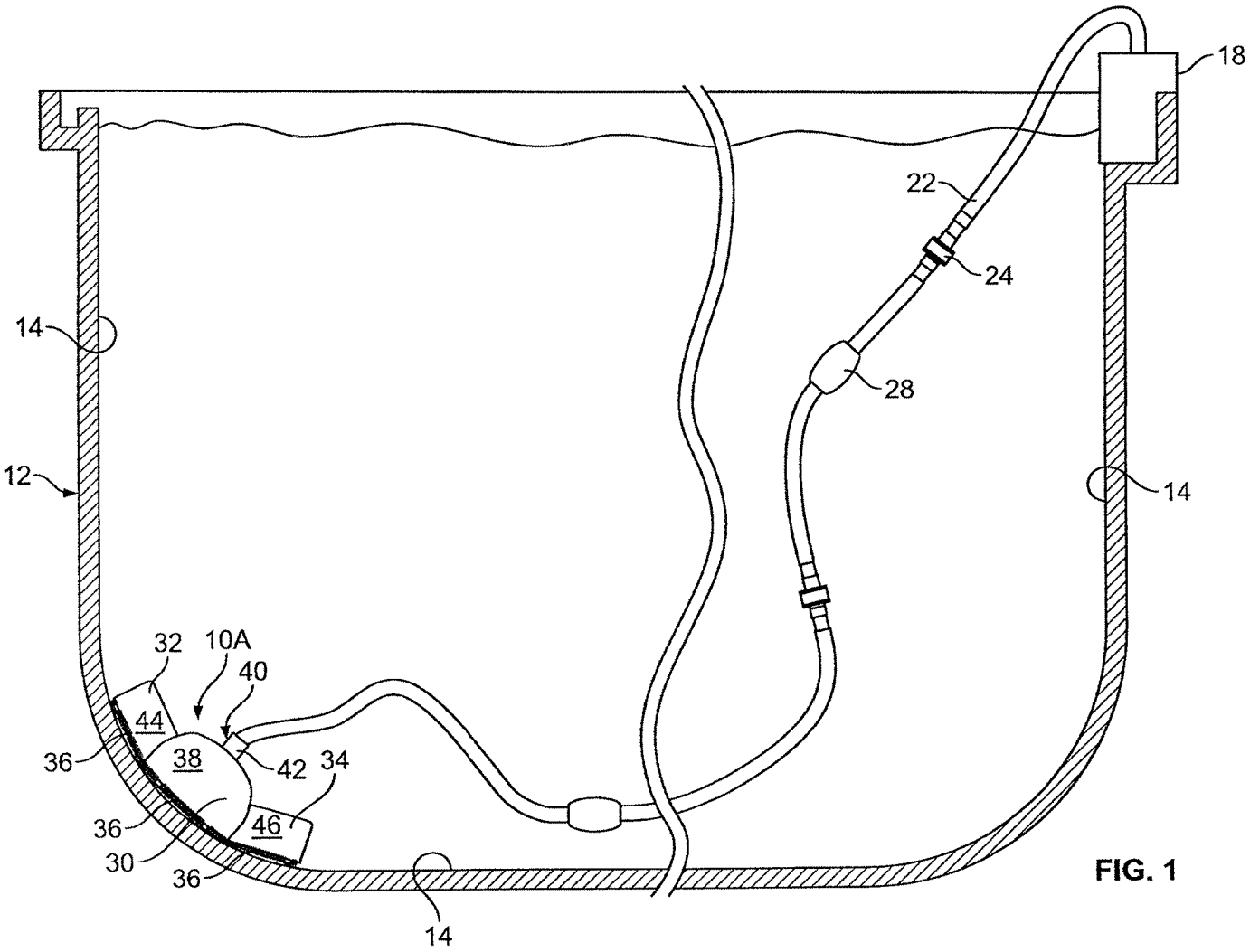
FIG. 1 shows an exemplary pool cleaner system for cleaning a swimming pool.

While an exemplary embodiment is described has a negative pressure (suction) pool cleaner, those skilled in the art will recognize that the other types of pool cleaners can be implemented in accordance with, and within the scope of, the present disclosure. For example, exemplary embodiments including positive pressure pool cleaner and/or electric pool cleaner can be implemented in accordance with the present disclosure. Furthermore, while exemplary embodiments are illustrated in FIGS. 1-16, those skilled in the art will recognize that embodiments of the present disclosure are not limited that which is illustrated in the FIGS. 1-16. Moreover, FIGS. 1-16 are provided for illustrative purposes and may not show common components and/or may represent such components schematically. As one example, while FIG. 1 depicts an application of a pool cleaner having a hose attached thereto, FIGS. 12-13 do not show the hose. However, one skilled in the art would recognize that the embodiment of the pool cleaner shown in FIGS. 12-13 would be connected to a hose and would include an inlet and an outlet as described with respect to certain exemplary embodiments of the present disclosure, as relating to positive or negative pressure cleaners, for examples. As another example, exemplary embodiments of the pool cleaners described include a drive system which is illustrated schematically. One skilled in the art will recognize that such a drive system can include electric motors, pumps, gears, belts, drive shafts, and/or any other suitable components utilized in a drive system to drive one or more wheels (and/or impellers) of a pool cleaner.

Referring to FIG. 1, a negative pressure (suction) pool cleaner 10A of the present disclosure is shown operating in a swimming pool 12. The pool cleaner 10A includes a body 30 and articulated cleaning members 32, 34, each of which can include one or more wheels and one or more brushes 36. The wheels support the cleaner 10A on the pool surface 14 and allow the cleaner 10A to traverse the pool surface 14, which can include, but is not limited surfaces of the pool floor, side walls, and pool features (e.g., benches, steps, infinity entrances, drain covers, and the like). In some embodiments, the cleaner 10A can include a drive system to drive some or all of the wheels and/or brushes. The brushes 36 can operate to scrub the pool wall 14 to loosen debris on the poll wall 14.

In exemplary embodiments, the body 30 can include a housing 38 and a chassis disposed within and supporting the housing 38. The body 30 can include an inlet port in fluid communication with an outlet port 40. Pool water can enter the pool cleaner 10A through the inlet port and can exit the pool cleaner 10A through the outlet port 40. The inlet port can be formed in a bottom surface of the body 30 so that the inlet port is in proximity to the pool surface 14 when cleaning the pool surface. The outlet port 40 can be defined by an external nozzle 42 extending outward from the housing 38 and/or formed integrally with the housing 38. The external nozzle 42 can facilitate connection of a hose thereto. The external nozzle 42 is generally a fluid outlet, such that water flows out of the pool cleaner 10A (e.g., exits) through the external nozzle 42 through a hose 22 to a fluid circulation line 18, which can include a suction port, filter assembly, and pump, as well as other components. For example, the outlet port 40 of the pool cleaner 10A can be operatively connected to a fluid circulation system 18 by the hose 22, putting the cleaner 10A in fluidic communication with the fluid circulation system 18. This connection allows the fluid circulation system 18 to provide negative pressure to the pool cleaner 10A to create a suction force at the inlet port of the cleaner 10A. For example, the fluid circulation system 18 can include a pump that creates a flow of water that enters the inlet port of the pool cleaner 10A, flows through the hose 22, and into the fluid circulation system 18. The suction force generated by the fluid circulation system 18 can urge the pool cleaner towards the pool surface 14 of the pool 12.

In some embodiments, the hose 22 can be a segmented hose that includes one or more swivels 24 and/or one or more floats 28 installed in-line with the segmented hose 22. As such, the water flowing through the segmented hose 22 would also flow through the one or more swivels 24 and one or more floats 28. The swivel 24 allows the segmented hose 22 to rotate at the swivel 24 location without detaching the cleaner 10A from the fluid circulation system 18. As such, when the cleaner 10A travels about the pool 12, the segmented hose 22 will rotate at the one or more swivels 24 whenever the segmented hose 22 begins to tangle, thus preventing entanglement.

The articulated cleaning members 32, 34 of the pool cleaner 10A can be operatively connected to the body 30 such that the articulated cleaning members 32, 34 are movable with respect to the body 30 of the pool cleaner 10A. For example, in one embodiment, the articulated cleaning members 32, 34 can be pivotally and/or rotatably coupled to the body 30 such that the articulated cleaning members 32, 34 can pivot and/or rotate with respect to body 30. In one embodiment, each of the articulated cleaning members 32, 34 can include a housing 44, 46, respectively. In exemplary embodiments, a biasing force can be applied to the articulated cleaning members 32, 34 to urge the articulated cleaning members 32, 34 towards the pool surface. A proximity of the articulated cleaning members 32, 34 to the pool surface 14 can be maintained by the biasing force. The biasing force applied to the articulated cleaning members 32, 34 can be less than the suction force generated by the cleaner 10A so that the pool cleaner 10A can effectively clean the pool surface 14 while accommodating changes in the terrain of the pool surface 14.

Figure 2:
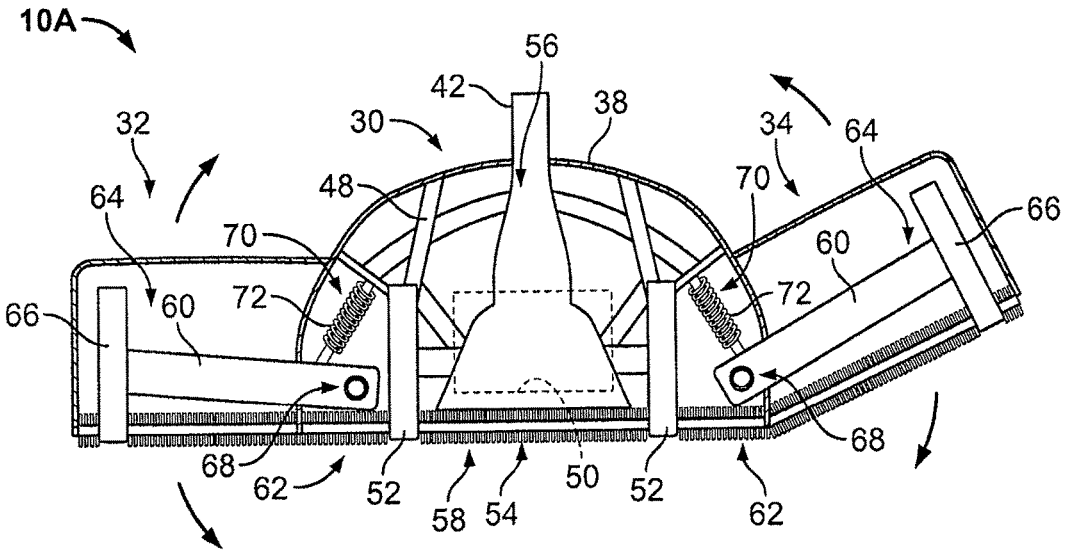
FIG. 2 shows a cross-sectional view of an embodiment of a pool cleaner in accordance with the present disclosure.

FIG. 2 shows a cross-sectional view of an embodiment of the pool cleaner 10A. The body 30 of the cleaner 10A includes a chassis 48. The chassis 48 supports the housing 38, a drive system 50, wheels 52, a suction head 54, and a suction aperture 56. The wheels 52 can be operatively coupled to the drive system 50 to facilitate an automatic cleaning function in which the wheels 52 are driven by the drive system 50 so that traversal of the pool by the cleaner 10A can be automated and/or controlled remotely. In exemplary embodiments, the drive system 50 can be an electronic drive system (e.g., the wheels 52 can be driven based on electric motor) or a pressure drive system (e.g., the wheels 52 can be driven based on a pressurized flow of water) the disclosures of which are incorporated herein by reference in their entirety. In some embodiments, the wheels 52 can freely rotate and the negative (suction) pressure can be used to move the cleaner 10A along the pool surface to be cleaned or a jet stream of water can be discharged from the cleaner 10A to propel the cleaner along the pool surface.

The suction head 54 and the suction aperture 56 are disposed within the housing 38 and define the inlet port of the cleaner 10A. The suction head 54 and the suction aperture 56 can be in fluid communication with the external nozzle 42. In exemplary embodiments, the suction head 54 can be formed as a pyramidal recess or funnel disposed towards a bottom wall 58 of the body 30 and extending to the suction aperture 56, which extends through the bottom wall 58. In some embodiments, the suction head 54 may include a rectangular perimeter that extends generally across the width of the bottom wall 58 of the body 30. In some embodiments, a perimeter of the suction head 54 may be circular. The suction head 54 functions to direct loosened debris into the suction aperture 56, this debris is pulled through the cleaner 10A by the negative pressure (suction) generated by the fluid circulation system 18. The suction force of the clean generated by the negative pressure can urge the body 30 of the cleaner towards the pool surface to be cleaned so that the wheels 52 are generally in contact with the pool surface and the suction head is disposed in close proximity to the pool surface. In exemplary embodiments, the suction force can be sufficient to pull debris into the suction aperture from an area generally corresponding to the a surface area of the base 30 of the cleaner and/or a surface area of the base 30 and a surface area of the articulated cleaning members such that as the cleaner 10A traverse the pool surface debris in the path of the cleaner is pulled into the suction aperture 56.

As shown in FIG. 2, the articulated cleaning members 32, 34 can each be operatively coupled to the body 30. In the present embodiment, the body 30 and the articulated cleaning members 32, 34 are configured to be laterally distributed to operate side-by-side with the body 30 such that the articulated cleaning members 32, 34 generally do not trail or lead the body 30 as the pool cleaner traverses the pool surface. For example, in the present embodiment, each of the articulated cleaning members 32, 34 can include at least one axle 60 having a proximal end 62 that is pivotally and/or rotatably connected to the chassis 48 of the body 30 at a side of the body 30 and a distal end 64 that is disposed laterally away from the side of the body and is operatively coupled to a wheel 66. The wheel 66 of each articulated cleaning members 32, 34 can freely rotate about its axis with respect to the axle 60. In some embodiments, the wheels 52 of the body 30 are driven to move the cleaner 10A and the wheels 66 of the articulated cleaning members 32, 34 rotate based on the friction between the wheels 66 and the pool surface. The axle 60 can be pivotally coupled to the chassis 48 of the body 30 via a joint 68. In exemplary embodiments, the joint 68 can be formed by one or more of a bolt and nut, a hinge, a rivet, and/or any other suitable structure that can be used to pivotally and/or rotatably couple the axle 60 to the chassis 48.

A biasing member 70 can be connected between each of the axles 60 and the chassis 48 to provide a biasing force to each of the axles 60 to urge the wheels 66 towards pool surface 14. In some embodiments, the biasing force can be sufficient to maintain contact between the wheels 66 of each articulated cleaning member 32, 34 and the pool surface. In some embodiments, biasing force can urge the articulated cleaning members towards the surface to be cleaned, but may not be sufficient to ensure contact between the wheel 66 and the pool surface in all circumstances. The biasing member can be a spring, hydraulic shock absorbers (e.g., a hydraulic cylinder and piston), pneumatic shock absorber (e.g., a pneumatic cylinder and piston), and/or any other suitable structure that can be used to apply a biasing force to the axle 60. In the present embodiment, the biasing member 70 is a spring 72 having a spring force that is less than the suction force generated by the cleaner 10A so that the articulated members 32, 34 do not force the suction inlet of the body 30 away from the pool surface. As shown in FIG. 2, the axle 60 of each articulated cleaning member 32, 34 can rotate clockwise and counterclockwise about the pivot point formed by the joint 68 at the proximal end 62 of each of the axles 60 so that the articulated cleaning members can be up and down with respect to the body 30. A degree to which each axle 60, and therefore, the articulated cleaning members 32,34, can rotate can be limited by, for example, the biasing member 70. In some embodiments, the chassis 48 can include at least one stop structure 74 to limit the rotation of each of the articulated cleaning members 32, 34, as shown in FIG. 3.

An orientation of the axles 60 and axis of rotation of the wheels 52, 66 can change with respect to each other as the articulated cleaning members 32, 34 pivot and/or rotate to accommodate the pool terrain. For example, as the cleaner 10A traverses a generally flat or planar portion of the pool surface, the axles 60 can be generally parallel and the axes of rotation of the wheels 52, 66 can be generally parallel. However, as one or both of the articulated cleaning members 32, 34 pivot and/or rotate to accommodate changes in the terrain, the orientation of the axles 60 can change such that they are angularly offset with respect to each other and the orientation of the axes of rotation of the wheels 52, 66 can be angularly offset with respect to each other.

Figure 3:
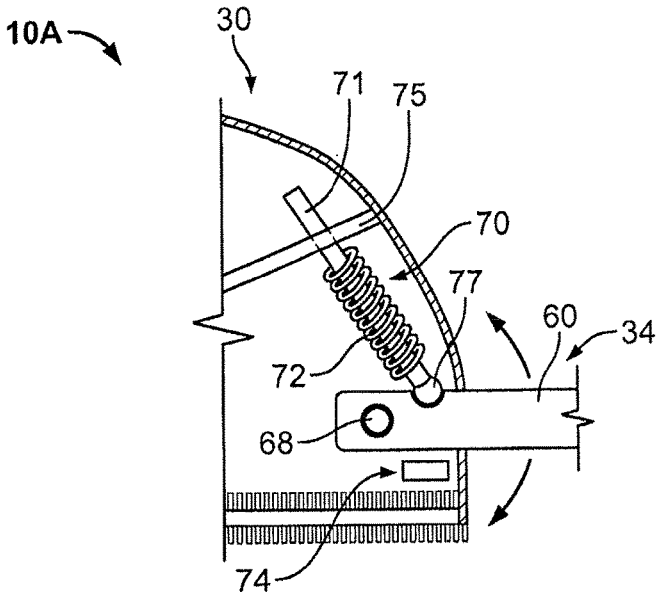
FIG. 3 shows an exemplary interaction between an articulated cleaning member and a body of the cleaner shown in FIG. 2.

FIG. 3 illustrates an exemplary interaction between the articulated cleaning member 34 and the body 30. While FIG. 3 is illustrative of the articulated cleaning member 34, the articulated cleaning member 32 can have the same or similar interaction with the body 30. As shown in FIG. 3, the axle 60 of the articulated cleaning member 34 can be operatively coupled to the chassis 48 via the joint 68, which can permit the axle 60 to pivot and/or rotate with respect to the chassis 48. An elongate shaft 71 can be operatively coupled to the axle 60 and extend away from the shaft and through an opening formed in a planar portion 75 of the chassis 48 that defines a plane that is generally perpendicular to the shaft 71. In exemplary embodiments, the shaft can be operative coupled to the axle 60 via a ball and socket joint 77 that allows the shaft 71 to pivot or rotate with respect to the axle 60. The biasing member 70 (e.g., spring 72 can be disposed about the shaft 71 and can extend between the axle 60 and the planar portion 75 of the chassis 48. When the axle 60 rotates counterclockwise in FIG. 3 (e.g. due to a force being exerted upwards on the articulated cleaning member), the shaft can be urged through the opening and the spring 72 can be compressed between the axle and the planar portion 75. When the axle 60 rotates clockwise in FIG. 3 (e.g. due to a force of the spring being exerted downwards on the articulated cleaning member), the shaft can be pulled through the opening 73 towards the axle 60 and the spring 72 can decompress. As the axle 60 continues to rotate clockwise, the axle 60 can engage the stop 74, which can be formed to prevent the axle from further clockwise rotation beyond the stop 74. The stop 74 can be an elongate member disposed beneath and in proximity to the joint 68 such that the axle 60 abuts the stop 74 at predetermined angle.

Figure 4:
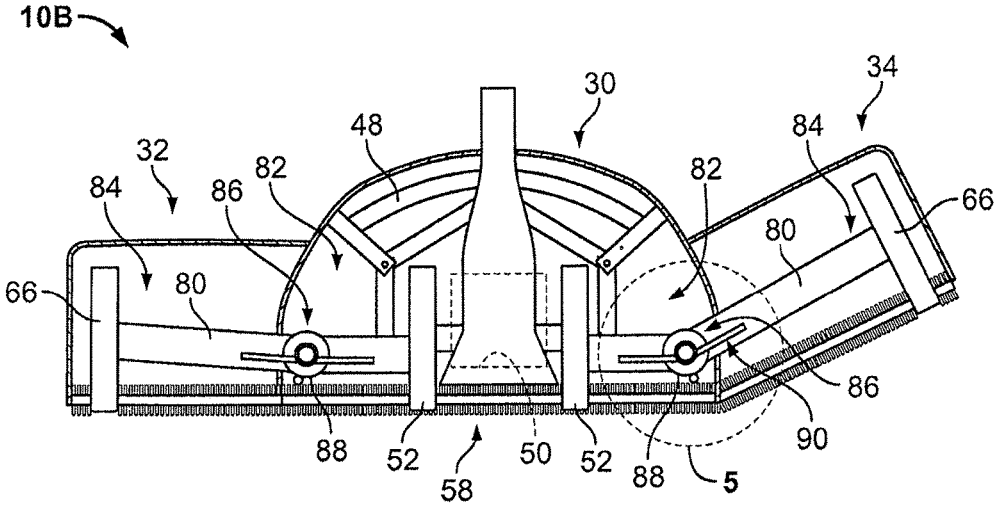
FIG. 4 shows a cross-sectional view of another embodiment of a pool cleaner in accordance with the present disclosure.
Figure 5:
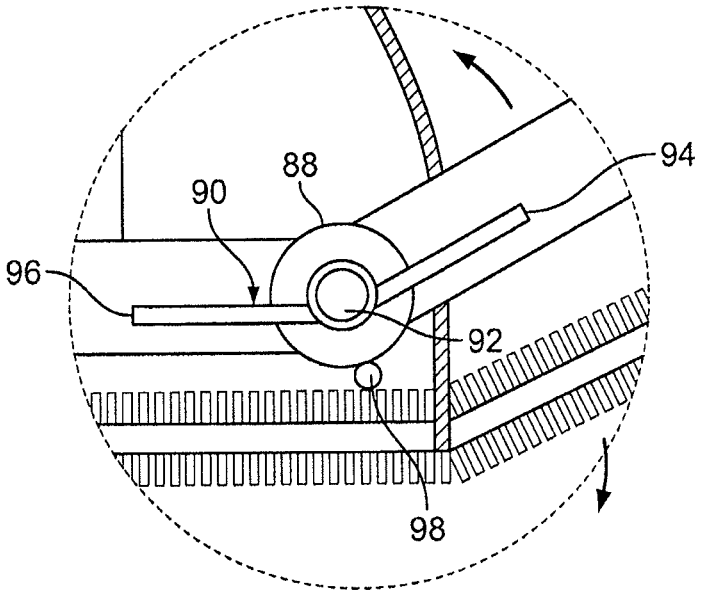
FIG. 5 shows a detail view of a portion of the pool cleaner of FIG. 4.

FIG. 4 shows a cross-sectional view of another embodiment of the pool cleaner 10B. FIG. 5 shows a more detailed view of the joint between the articulated cleaning member 34 and the body 30. The body 30 of the cleaner 10B includes the chassis 48, which supports the housing 38, the drive system 50, the wheels 52, the suction head 54 and the suction aperture 56, each of which have a structure and operation as described above with respect to FIGS. 1 and 2.

As shown in FIGS. 4 and 5, the articulated cleaning members 32, 34 can each be operatively coupled to the body 30. For example, in the present embodiment, each of the articulated cleaning members 32, 34 can include the at least one axle 80 having a proximal end 82 that is pivotally and/or rotatably connected to the chassis 48 of the body 30 and a distal end 84 that is operatively coupled to the wheel 66. The wheel 66 can be freely rotate about its axis with respect to the axle 80. In some embodiments, the wheels 52 of the body 30 are driven to move the cleaner 10B and the wheels 66 of the articulated cleaning members 32, 34 rotate due to the friction between the wheels 66 and the pool surface. The axle 80 of each of the articulated cleaning members 32, 34 can be pivotally and/or rotatably coupled to the chassis 48 of the body 30 via a joint 86 formed by a hinge 88.

Each hinge 88 can include a biasing member 90, such as a torsion spring 92, and can be connected between the axle 80 of each of the articulated cleaning members 32, 34 and the chassis 48 to provide a biasing force to the axles 80 to urge the wheels 66 towards pool surface 14 during a cleaning operation of the cleaner. In the present embodiment, the a first elongate end 94 of each torsion spring 92 can extend towards the axle 80 and a second elongate end 96 of the torsion spring 92 can extend towards the chassis 48. Each spring 92 can be wound such that the first and second ends 94, 96 of the spring 92 apply a spring force to urge each of the articulated cleaning members 32, 34 to rotate towards the bottom surface 58 of the body 30. Likewise, the spring 92 can be wound to resist rotation of the articulated cleaning members 32, 34 towards a top of the body 30. The spring 92 can have a spring force that is less than the suction force generated by the cleaner 10B. Each axle 80 can rotate clockwise and counterclockwise about the pivot point formed by the joint 88 at the proximal end 82 of each axle 80. A degree to which each axle 80, and therefore the articulated cleaning members 32,34, can rotate can be limited by, for example, at least one stop structure 98. In the present embodiment, the at least one stop structure 98 can limit the rotation of each of the articulated cleaning members 32, 34 towards the bottom of the body 30.

Figure 6:
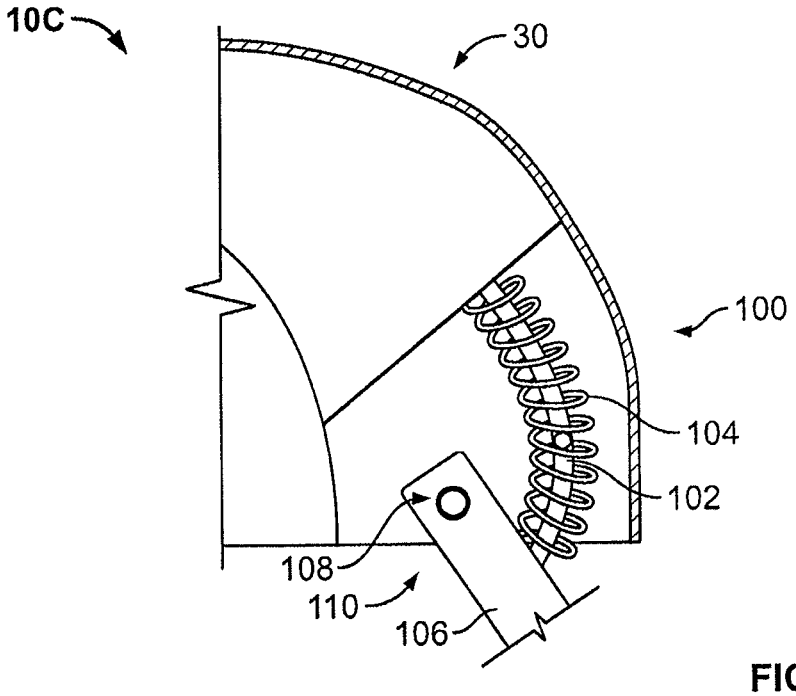
FIG. 6 shows an exemplary biasing member disposed between one of the articulated cleaning members and the body of the pool cleaner in accordance with the present disclosure.

FIG. 6 shows another exemplary biasing member 100 that can be disposed between the chassis 48 of the body 30 and each articulated cleaning members 32, 34 in accordance with an exemplary embodiments of a pool cleaner 10C. In the present embodiment, the biasing member 100 can include an arcuate slide joint 102 and coil spring 104. The spring 104 can be disposed about the arcuate joint 102 such the length of the spring 104 general conforms to the arc formed by the arcuate slide joint 102. In the present embodiment, the spring 104 can have a spring force that is less than the suction force generated by the cleaner 10C. Each axle 106 (e.g., axles 60, 80) can rotate clockwise and counterclockwise about the pivot point formed by a joint 108 (e.g., 68, 88) at the proximal end 110 of the axle. The spring 104 can apply the spring force to urge each of the articulated cleaning members 32, 34 to rotate towards the bottom surface of the body 30. Likewise, the spring 104 resist rotation of the articulated cleaning members towards a top of the body 30. A degree to which the axle 106, and therefore the articulated cleaning members 32,34, can rotate can be limited by, for example, the arcuate slide joint 102.

Figure 7:
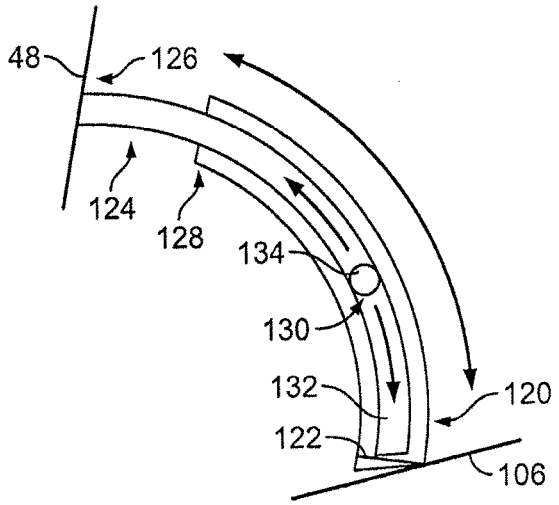
FIG. 7 shows an arcuate slide joint illustrated in FIG. 6.

FIG. 7 shows an embodiment of the arcuate slide joint 102 of FIG. 6. The arcuate slide joint 102 can include a first arcuate member 120 having a first end 122 operatively coupled to the axle 106 and can include a second arcuate member 124 having a first end 126 operatively coupled to the chassis 48. Second ends 128, 130 of the first and second arcuate members 120, 124 can form free ends of the respective members 120, 124. The first arcuate member 120 can have a slide channel 132 formed therein. The slide channel 132 can extend along the arc of the first arcuate member 120 and can terminate at the ends 122, 128 of the first arcuate member 120. The second arcuate member 124 can extend along an arc having a radius that is substantially identical to the radius of the arc formed by the first arcuate member 120. The second arcuate member 124 can include a slide member 134 at the second end 130 configured to engage and be slidingly secured to the slide channel 132 of the first arcuate member 120. The slide member 134 can slide along the slide channel 132 between the first and second ends 122, 128 of the first arcuate member 120. The first and second ends 122, 128 of the first arcuate member 120 can form stop structures that limit the range of motion of the slide member 134.

Figure 8:
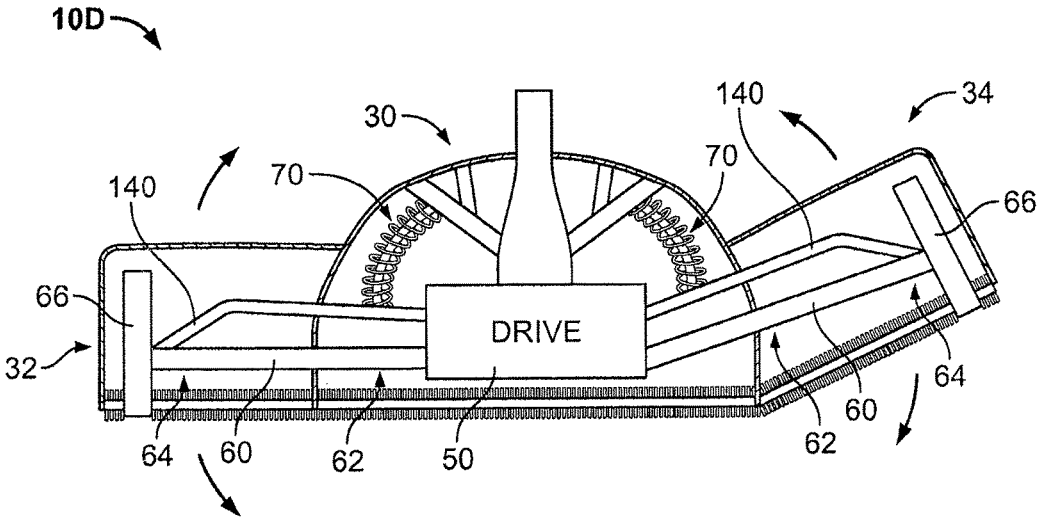
FIG. 8 shows a cross-sectional view of an embodiment of a pool cleaner in accordance with the present disclosure.

FIG. 8 shows another embodiment of the pool cleaner 10D for which the wheels 66 of the articulated cleaning members 32, 34 are driven. The body 30 can be implemented in a similar manner to the above described embodiments. The wheels 66 of the articulated cleaning members 32, 34 can be operatively and fixedly attached to the distal end 64 of the axle 60. The proximal end 62 of the axle 60 can be operatively, rotatably, and pivotally, coupled to the drive system 50 such that the drive system 50 is operative to rotate the axle 60 about its axis, and thereby rotate the wheels 66. A rod 140 can be operatively coupled to the distal end 64 of the axle 60 and to the body 30 and the biasing member 70 can be operatively coupled between the rod 140 and the body to enable the articulated cleaning members 32, 34 to pivot or rotate clockwise and/or counterclockwise.

Figure 9:
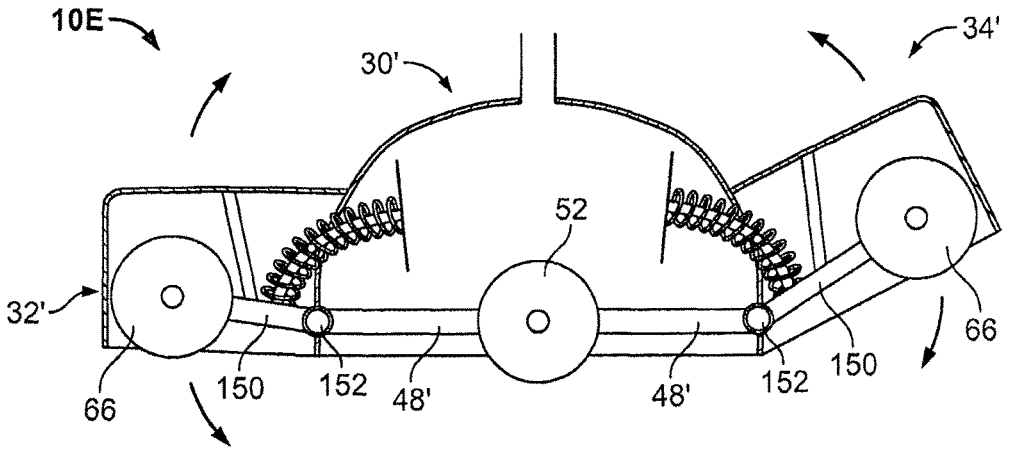
FIG. 9 shows a cross-sectional view of an embodiment of a pool cleaner in accordance with the present disclosure.
Figure 10:
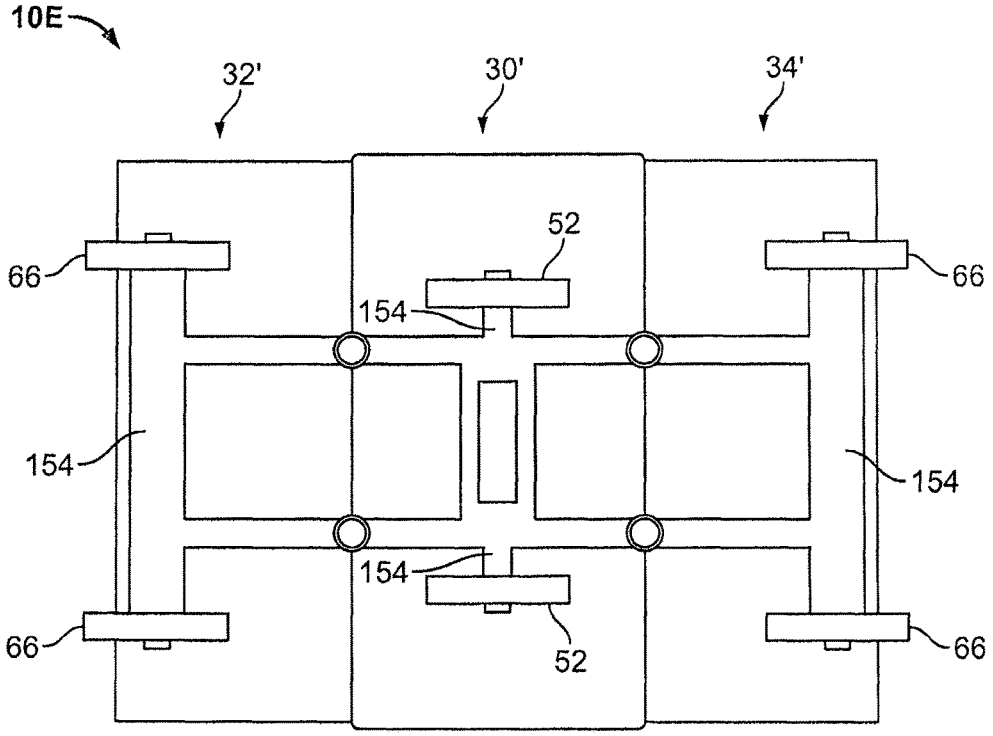
FIG. 10 shows a diagrammatic bottom view of a portion of the pool cleaner of FIG. 9.

FIG. 9 shows another exemplary embodiment of a cleaner 10E in accordance with the present disclosure. FIG. 10 shows a bottom view of an interconnection between the body and the articulated cleaning members of FIG. 9. The cleaner 10E can include a body 30' and articulated cleaning members 32', 34'. The body 30' can be implemented in a similar manner as embodiments of the body 30. In the present embodiment, a frame 150 of each of the articulated cleaning members 32', 34' can be operatively and pivotally coupled to the chassis 48' of the body 30' by joints 152 and/or a biasing member, which can be implemented in a manner similar to the above described embodiments of the joint and biasing members. The wheels 52, 66 of the body 30' and the articulated cleaning members 32', 34' can rotate about their respective axes and may or may not be driven by a drive system, as described herein. Axles 154 and axes of rotation of the wheels 52, 66 can be generally parallel to each other such that when the articulated cleaning members 32', 34' pivot or rotated to accommodate the pool terrain, the axles 154 can be vertically offset from each other, but maintain their parallel orientation. In the present configuration, one of the articulated cleaning members 32', 34' can form a leading portion of the cleaner 10E (e.g., a front) and the other one of the articulated cleaning members 32', 34' can form a trailing portion of the cleaner 10E (e.g., a rear) depending on the direction in which the cleaner 10E is moving.

Figure 11:
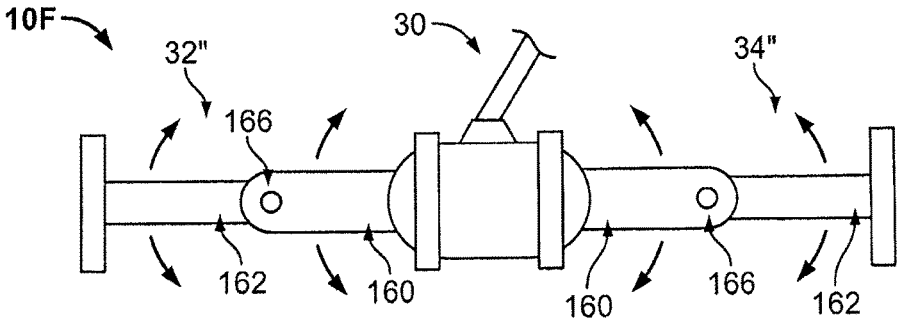
FIG. 11 shows a cross-sectional view of an embodiment of a pool cleaner in accordance with the present disclosure.

FIG. 11 is another embodiment of the pool cleaner 10F having compound articulated cleaning members 32", 34". The body 30 can be implemented in a similar manner to the above described embodiments. In the present embodiment, the articulated cleaning members 32", 34" can be operatively coupled to the body 30. As shown in FIG. 11, the articulated cleaning members 32", 34" can be include sub-segments 160, 162, respectively. The sub-segments 160 can be operatively, pivotally, and rotationally coupled to the body 30 and the sub-segments 162 can be operatively, pivotally, and rotationally coupled to the sub-segments 160. The sub-segments 160 of the articulated cleaning members 32", 34" can be operatively coupled to body 30 by one or more joints 166 in a similar manner as the above described embodiments to facilitate pivotal and rotational movement of the of the sub-segments 160, and therefore, the articulated cleaning members 32", 34" with respect to the body 30. The sub-segments 162 of the articulated cleaning members 32", 34" can be operatively coupled to the sub-segments 160 in a manner similar to the above described embodiments to facilitate pivotal and rotational movement of the of the sub-segments 162 with respect to the sub-segments 160 and the body 30. The sub-segments 160, 162 can facilitate compound movements of the articulated cleaning members 32", 34" to accommodate changes in the terrain of the pool.

Figure 12:
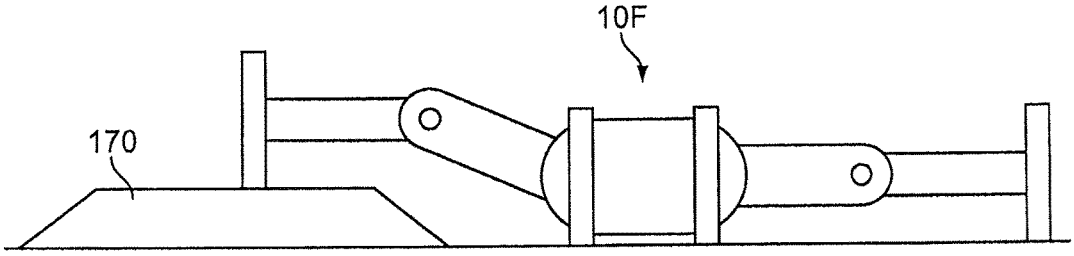
FIGS. 12 and 13 show an exemplary embodiment of the pool cleaner of FIG. 11 traversing terrain of a swimming pool having varying terrain.
Figure 13:
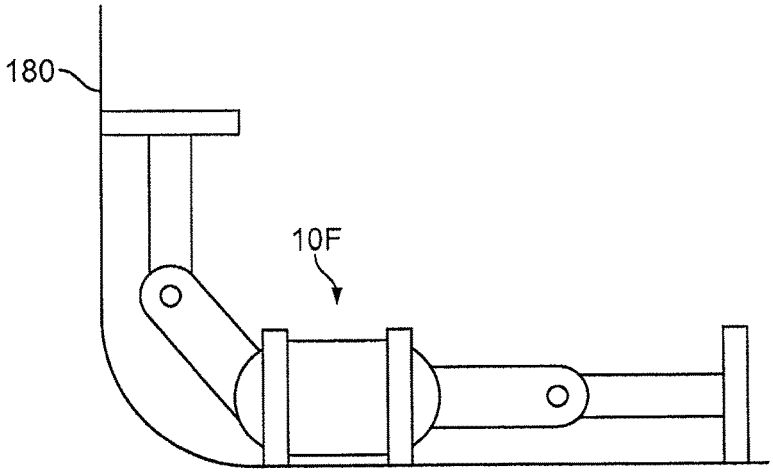

FIGS. 12 and 13 shows the pool cleaner 10F of FIG. 11 traversing terrain of a swimming pool having another varying topology. As the cleaner 10F traverse a pool it may encounter features or structures in the pool, such as, for example, a drain cover 170 (FIG. 12) or a side wall 180 (FIG. 13), the sub-segments 160, 162 of the articulated cleaning members 32", 34" can each rotate in a clockwise or counterclockwise manner while the suction generated by the body generally assists in maintaining an effective position of the cleaner 10F with respect to the surface to be cleaned.

Figure 14:
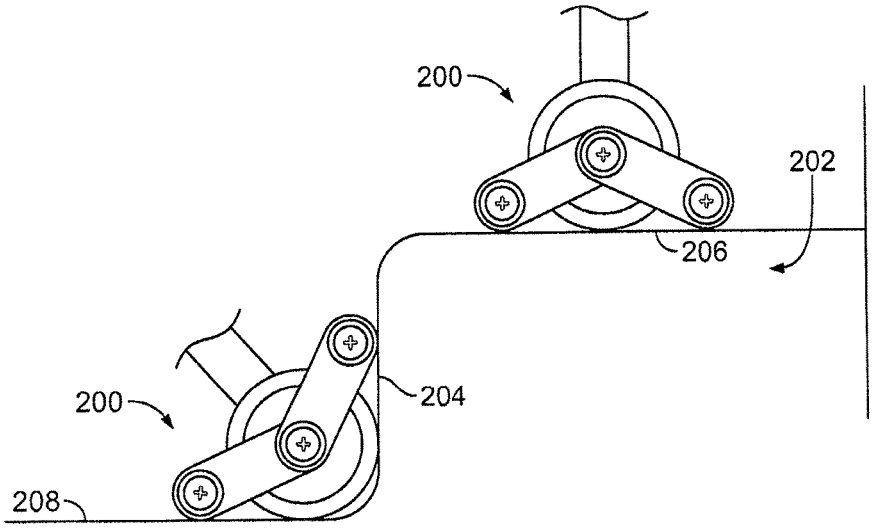
FIGS. 14 and 15 show an exemplary embodiment of the pool cleaner traversing terrain of a swimming pool having another varying terrain.
Figure 15:
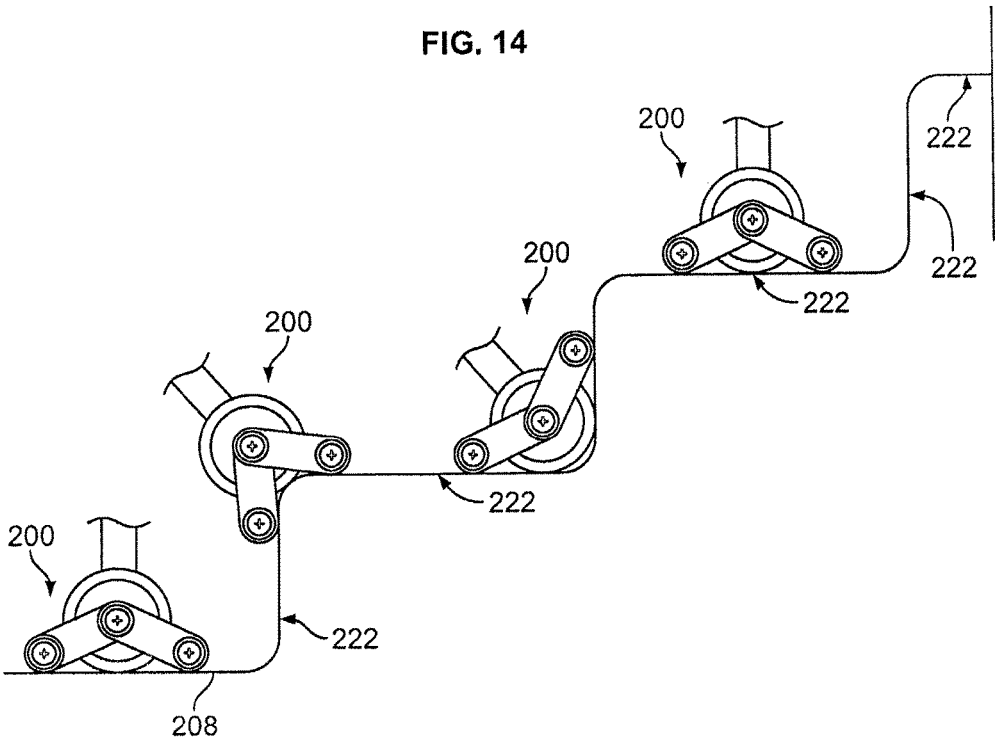

FIGS. 14 and 15 show an exemplary embodiment of a pool cleaner 200 traversing terrain of a swimming pool having a varying topology. In the present embodiment, the cleaner 200 can be implemented in accordance with the above described embodiments (e.g., cleaners 10A-F). As the cleaner 200 traverses a pool terrain it may encounter features or structures in the pool, such as, for example, a bench 202 (FIG. 14) generally formed by a segment 204 extending perpendicularly from a pool floor 208 and a segment 206 extending generally parallel to the pool floor 208 from the segment 204 to a side wall 210 of the pool or pool steps 220 (FIG. 15) formed by interleaved segments 222 extending perpendicular and parallel to the pool floor 208. To accommodate the changing terrain, the articulated cleaning members (e.g., 32, 34; 32', 34'; 32", 34") can rotate in a clockwise or counterclockwise manner while the suction generated by the body (e.g., 30, 30') generally assists in maintaining an effective position of the cleaner 200 with respect to the surface to be cleaned.

Figure 16:
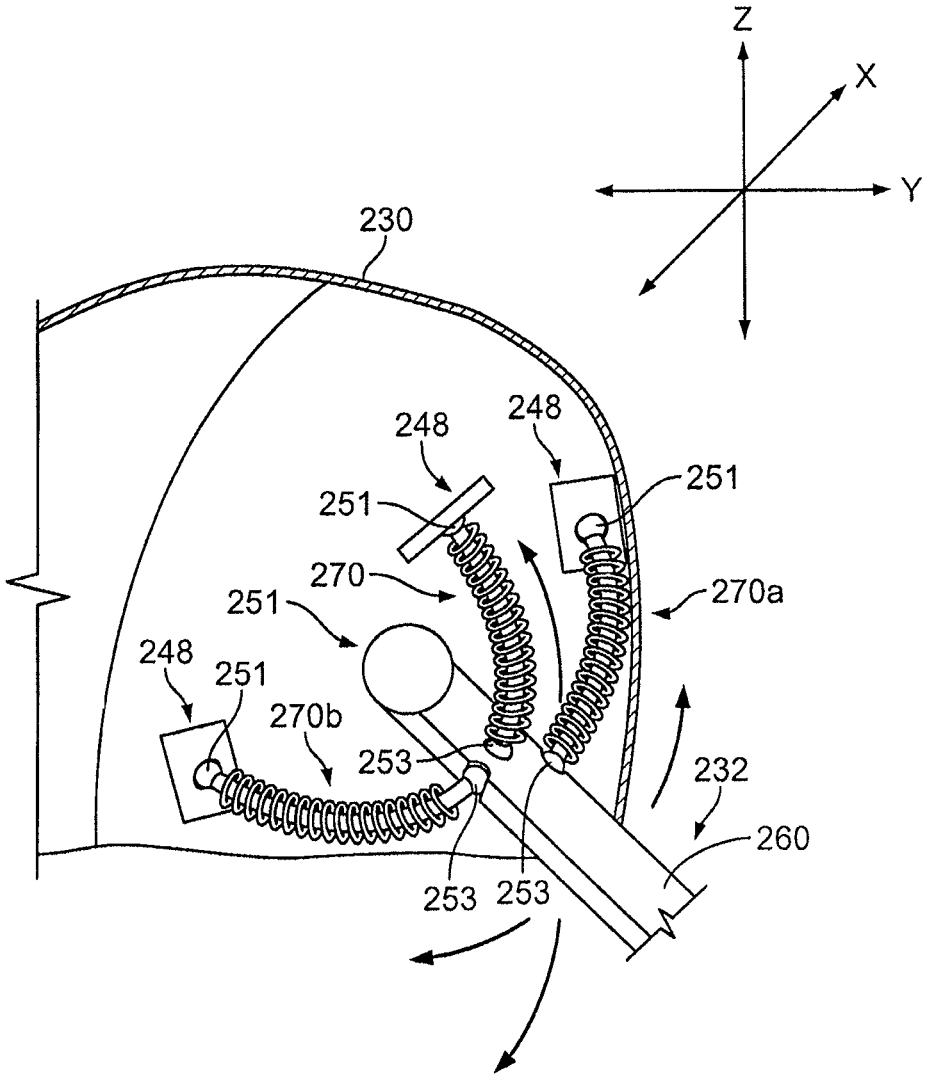
FIG. 16 shows a partial perspective view of an exemplary pool cleaner to illustrate another exemplary interaction between an articulated cleaning member and a body of the pool cleaner.

FIG. 16 shows a partial perspective view of an exemplary embodiment in accordance with the present disclosure to illustrate another exemplary interaction between articulated cleaning members (e.g., 32, 32', 34, 34') and the body (e.g., 30, 30') of the cleaner (e.g., cleaners 10A-F). An articulated cleaning member 232 can be operatively coupled to a chassis 248 disposed within a cleaner body 230. The cleaner body 230, articulated cleaning member 232, and chassis 248 can be implemented in a similar manner as embodiments described herein except as described herein below. The articulated cleaning member 232 and biasing members 270, 270*a*, and 270*b* can be operatively coupled to the chassis 248 via ball and socket joints 251. Likewise the biasing members 270, 270*a*, and 270*b* can be operatively coupled to the axle 260 via ball and socket joints 253. The ball and socket joints 251 and 253 allow the articulated cleaning member 232 and biasing members 270, 270*a*, and 270*b* to rotate up and down (e.g., vertically) and side-to-side (e.g., laterally) with respect to the body 230 as well as a simultaneous vertically and lateral movement with respect to the body 230. To facilitate vertical movement, the biasing member 270, which can be implemented in a similar manner as the biasing member shown in FIGS. 6-7) can be operatively connected between an upper surface of an axle 260 of the articulated cleaning member 232 and the chassis 248 (e.g., in a plane defined by a z-axis and an y-axis). To facilitate lateral movement of the articulated cleaning member 232, the biasing members 270*a* and 270*b* can be operatively coupled to opposing sides of the axle 260 and the chassis 248 (e.g., in a plane defined by the y-axis and an x-axis). The biasing members 270*a* and 270*b* can be implemented in a similar manner as the biasing member 270 except that rather than being disposed generally vertically (e.g., in the plane defined by the z-axis and the y-axis), the biasing members 270*a* and 270*b* are disposed horizontally (e.g., in the plane defined by the x-axis and the y-axis). While only the articulated cleaning member 232 is shown in FIG. 16, those skilled in the art will recognize that at least one further articulated cleaning member can be operatively coupled to the base 230 in a similar manner as the articulated cleaning member 232.

While exemplary embodiments have described with reference to a negative pressure (suction) cleaner, those skilled in the art will recognize that other types of pool cleaners can be implemented in accordance with and within the scope of the present disclosure. For example, exemplary embodiments of the cleaner can be implemented as a positive pressure pool cleaner and/or an electric pool cleaner, which may include an electronic drive system including an electric transmission and drive motor.

While preferred embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

What is claimed is:

1. An apparatus for cleaning a swimming pool, comprising:

a body having a pair of opposingly spaced wheels, an inlet disposed between the wheels through which water enters the body, and an outlet through which water exits the body;

an articulated cleaning member operatively coupled laterally side-by-side with the body and adjacent to a first one of the wheels, the articulated cleaning member being separated from the inlet by the first one of the wheels and being moveable with respect to the body to accommodate changes in terrain of a pool surface; and a biasing member operatively coupled to the body and the articulated cleaning member and configured to apply a biasing force to urge the articulated cleaning member towards the pool surface;

wherein the body generates a suction force to urge a bottom of the body towards the pool surface, and wherein the suction force is greater than the biasing force.

2. An apparatus for cleaning a swimming pool comprising:

a body having a pair of opposingly spaced wheels, an inlet disposed between the wheels through which water enters the body, and an outlet through which water exits the body;

an articulated cleaning member operatively coupled laterally side-by-side with the body and adjacent to a first one of the wheels, the articulated cleaning member being separated from the inlet by the first one of the wheels and being moveable with respect to the body to accommodate changes in terrain of a pool surface; and a biasing member operatively coupled to the body and the articulated cleaning member and configured to apply a biasing force to urge the articulated cleaning member towards the pool surface;

wherein the articulated cleaning member comprises a housing, a wheel, and an axle operatively coupled to the wheel, the axle operatively coupling the articulated cleaning member to the body.

3. The apparatus of claim 2, wherein the axle is driven to rotate the wheel.

4. The apparatus of claim 2, wherein the axle is operatively coupled to the body by a joint.

5. The apparatus of claim 4, wherein the joint permits pivotal or rotational movement of at least one of the articulated cleaning member with respect to the body.

6. The apparatus of claim 2, wherein the biasing member comprises a spring.

7. An apparatus for cleaning a swimming pool comprising:

a body having an inlet through which water enters the body and an outlet through which water exits the body;

a first articulated cleaning member laterally extending from and operatively coupled to a first side of the body, the first articulated cleaning member being moveable with respect to the body to accommodate changes in terrain of a pool surface and operating on the first side of the body;

a first biasing member operatively coupled between the body and the first articulated cleaning member to urge the articulated cleaning member towards a surface to be cleaned a second articulated cleaning member extending from and operatively coupled to a second side of the body, the second articulated cleaning member being moveable with respect to the body to accommodate changes in terrain of the pool surface; and a second biasing member operatively coupled between the body and the second articulated cleaning member to urge the second articulated cleaning member towards the surface to be cleaned.

8. The apparatus of claim 7, wherein the body generates a suction force to urge a bottom of the body towards the pool surface and the first biasing member applies a biasing force to the first articulated cleaning member, wherein the suction force is greater than the biasing force.

9. The apparatus of claim 7, wherein the first and second articulated cleaning members are each operatively coupled to the body by a hinge.

10. The apparatus of claim 7, wherein the first biasing member applies a biasing force to the first articulated cleaning member to urge the first articulated cleaning member towards the pool surface during an cleaning operation.

11. The apparatus of claim 10, wherein the biasing member is one of a coil spring or a torsion spring.

12. A method of clean a pool comprising:

submerging a pool cleaner in a pool, the pool cleaner having a body that includes a pair of opposingly spaced wheels, an inlet disposed between the wheels through which water enters the body, an outlet through which water exits the body, an articulated cleaning member operatively configured to be laterally coupled to operate side-by-side with the body, the articulated cleaning member being adjacent to a first one of the wheels, the articulated cleaning member being separated from the inlet by the first one of the wheels and being moveable with respect to the body to accommodate changes in terrain of a pool surface, and a biasing member operatively coupled to the body and the articulated cleaning member and configured to apply a biasing force to urge the articulated cleaning member towards the pool surface;

traversing a terrain of an immersed surface of the pool by the pool cleaner;

rotating the articulated cleaning member with respect to the body in response to a difference in an elevation of the immersed surface between the articulated cleaning member and the body; and urging the articulated cleaning member towards the immersed surface via the biasing force that is less than a suction force generated by the pool cleaner.

13. The method of claim 12, further comprising:

rotating the articulated cleaning member with respect to the body in response to the elevation of the immersed surface between the articulated cleaning member and the body being substantially equal.

* * * * *